United States Patent [19]

Dornsbusch et al.

[11] Patent Number: 4,749,108

[45] Date of Patent: Jun. 7, 1988

[54] BIMODAL STORAGE AND DISPENSING PACKAGE INCLUDING SELF-SEALING DISPENSING VALVE TO PROVIDE AUTOMATIC SHUT-OFF AND LEAK-RESISTANT INVERTED STORAGE

[75] Inventors: Arthur H. Dornsbusch; James L. Drobish; Roger E. Schanzle; Leo E. Taske; Robert W. Blaut, all of Cincinnati, Ohio

[73] Assignee: The Procter & Gamble Company, Cincinnati, Ohio

[21] Appl. No.: 109,663

[22] Filed: Oct. 15, 1987

Related U.S. Application Data

[63] Continuation-in-part of Ser. No. 944,632, Dec. 19, 1986, abandoned.

[51] Int. Cl.[4] ..... B65D 5/72

[52] U.S. Cl. ..... 222/212; 222/490; 222/494; 222/545; 222/556

[58] Field of Search ..... 222/206, 212, 215, 490, 222/491, 494, 538, 544, 545–546, 547, 556, 564; 215/235–237, 273; 220/259, 337–338

[56] References Cited

U.S. PATENT DOCUMENTS

| | | | |
|---|---|---|---|
| 1,206,661 | 11/1916 | Booth | 222/490 |
| 1,242,654 | 10/1917 | Chapman . | |
| 1,825,553 | 9/1931 | Smith | 222/490 |
| 1,989,145 | 1/1935 | Newby | 221/60 |
| 1,989,714 | 2/1935 | Statham | 221/60 |
| 1,989,715 | 2/1935 | Stratham | 221/60 |
| 2,098,799 | 11/1937 | Wilson | 221/16 |
| 2,175,052 | 10/1939 | Bull et al. | 221/60 |
| 2,176,513 | 10/1939 | Smith | 221/60 |
| 2,193,517 | 3/1940 | Lindstrom | 221/60 |
| 2,441,649 | 5/1948 | Sprague | 222/92 |
| 2,571,010 | 10/1951 | Busch | 215/11 |
| 2,611,515 | 9/1952 | Smith | 222/213 |
| 2,625,306 | 1/1953 | Murphy | 222/498 |
| 2,670,757 | 3/1954 | Delany | 137/515 |
| 2,684,789 | 7/1954 | Marchant | 222/212 |
| 2,688,979 | 9/1954 | Kendrick | 137/512.15 |
| 2,718,987 | 9/1955 | Kimball | 222/193 |
| 2,743,852 | 5/1956 | Alberdi, Jr. | 222/494 |
| 2,753,091 | 7/1956 | Herzig | 222/491 |
| 2,942,762 | 6/1960 | Fahr | 222/207 |
| 2,957,501 | 10/1960 | Holmes | 141/2 |
| 3,007,614 | 11/1961 | Morrow | 222/490 |
| 3,012,698 | 12/1961 | Wiederquist et al. | 222/212 |
| 3,016,172 | 1/1962 | Morrow et al. | 222/490 |
| 3,067,787 | 12/1962 | Salk | 141/321 |
| 3,091,373 | 5/1963 | Kirschenbaum | 222/420 |
| 3,182,694 | 5/1965 | Raimo | 141/321 |
| 3,241,726 | 3/1966 | Chester | 222/211 |
| 3,258,175 | 6/1966 | Taylor | 222/380 |
| 3,273,754 | 9/1966 | Lindley | 222/92 |

(List continued on next page.)

FOREIGN PATENT DOCUMENTS

| | | |
|---|---|---|
| 969571 | 9/1940 | Fed. Rep. of Germany . |
| 1486403 | 5/1969 | Fed. Rep. of Germany . |
| 996998 | 12/1951 | France . |
| 764928 | 1/1957 | United Kingdom . |
| 1046518 | 10/1966 | United Kingdom . |
| 2098958A | 12/1982 | United Kingdom . |
| 2158049A | 11/1985 | United Kingdom . |
| 145824 | 6/1962 | U.S.S.R. . |

*Primary Examiner*—Michael S. Huppert

*Attorney, Agent, or Firm*—E. Kelly Linman; John V. Gorman; Richard C. Witte

[57] ABSTRACT

A flexible storage and dispensing package for fluid material. The package has a first mode of operation capable of storing the fluid material without leakage when the package is subjected to unintentional external forces and a second mode of operation capable of dispensing the fluid material when the package is subjected to external forces intentionally applied by the user. The second mode of operation is capable of dispensing the fluid material through a discharge orifice in response to manually applied forces and of automatically ceasing the dispensing operation when the manually applied forces are removed. The package is also resistant to leakage in the second mode of operation when stored with its discharge orifice downwardly oriented intermediate dispensing cycles.

20 Claims, 14 Drawing Sheets

U.S. PATENT DOCUMENTS

| | | | |
|---|---|---|---|
| 3,418,055 | 12/1968 | Schwartzman | 401/206 |
| 3,445,042 | 5/1969 | Elmore et al. | 222/212 |
| 3,618,825 | 11/1971 | Clarke | 222/494 X |
| 3,669,323 | 6/1972 | Harker et al. | 222/490 |
| 3,674,183 | 7/1972 | Venable et al. | 222/212 |
| 3,693,843 | 9/1972 | Perry et al. | 222/212 |
| 3,693,847 | 9/1972 | Gibson | 222/546 |
| 3,822,811 | 7/1974 | Landen | 222/562 |
| 3,884,394 | 5/1975 | Hazard | 222/153 |
| 3,893,593 | 7/1975 | Hazard | 222/48 |
| 3,980,211 | 9/1976 | Owens | 222/478 |
| 4,096,597 | 6/1978 | Duse | 4/255 |
| 4,124,150 | 11/1978 | Moss | 222/494 |
| 4,133,457 | 1/1979 | Klassen | 222/212 |
| 4,139,124 | 2/1979 | Ferrante | 222/110 |
| 4,226,342 | 10/1980 | Laauwe | 222/494 |
| 4,241,855 | 12/1980 | Yoshioka | 222/479 |
| 4,314,658 | 2/1982 | Laauwe | 222/213 |
| 4,349,134 | 9/1982 | Schuster et al. | 222/212 |
| 4,356,935 | 11/1982 | Kamin | 222/1 |
| 4,408,702 | 10/1983 | Horvath | 222/212 |
| 4,420,101 | 12/1983 | O'Neill | 222/212 |
| 4,433,800 | 2/1984 | Owens | 222/547 |
| 4,457,454 | 7/1984 | Meshberg | 222/95 |
| 4,474,313 | 10/1984 | Sieverding | 222/211 |
| 4,519,530 | 5/1985 | Schmidt | 222/494 |
| 4,533,069 | 8/1985 | Drobish | 222/209 |
| 4,564,130 | 1/1986 | Eulenburg | 222/207 |
| 4,580,701 | 4/1986 | Tamaki | 222/92 |
| 4,600,131 | 7/1986 | Roof et al. | 222/478 |
| 4,646,945 | 3/1987 | Steiner et al. | 222/207 |
| 4,660,747 | 4/1987 | Borg et al. | 222/213 |
| 4,565,306 | 1/1986 | Nakanishi et al. | 222/383 |

BIMODAL STORAGE AND DISPENSING PACKAGE INCLUDING SELF-SEALING DISPENSING VALVE TO PROVIDE AUTOMATIC SHUT-OFF AND LEAK-RESISTANT INVERTED STORAGE

This is a continuation-in-part of application Ser. No. 944,632, filed on Dec. 19, 1986, now abandoned.

TECHNICAL FIELD

The present invention has relation to a package for storing and dispensing various fluids or fluidized materials.

The present invention has further relation to such a package having a first mode of operation capable of storing said fluid or fluidized material without leakage when the package is subjected to unintentionally applied external forces, particularly suddenly applied forces, and a second mode of operation capable of dispensing fluid or fluidized material when the package is subjected to external forces intentionally applied by the user.

The present invention has further relation to a package for storing and dispensing viscous fluid materials such as shampoos, conditioners, soaps, detergents, and the like in said second mode of operation without the need to remove or manipulate the closure member normally used to prevent dryout or loss of the package contents intermediate dispensing cycles.

The present invention has particular relation to a flexible package provided with a dispensing valve which, in said second mode of operation, will open to discharge the package contents at a predetermined threshold pressure when external forces are applied to the package, but which will close spontaneously when the external forces are removed from the package. Since the valve remains closed below the chosen threshold pressure in said second mode of operation, the package may be handled without inadvertent discharge and stored inverted if so desired.

The present invention has further relation to such a flexible package wherein the dispensing valve in said first mode of operation is provided with restraining means to resist the discharge of fluid material from said valve when said package is subjected to unintentionally applied external forces such as shock or compressive loadings.

In a particularly preferred embodiment, the present invention has relation to such a package including a dispensing valve sealingly secured across the discharge orifice of said flexible package. The dispensing valve includes an internal passageway which places the interior of the container portion of said package in fluid communication with the interior surfaces of said valve, said package further including restraint means to prevent said internal passageway from collapsing upon itself when said package is subjected to sudden, unintentionally applied external forces.

Finally, the present invention has relation to such a package including a baffle oriented substantially perpendicular to the axis of said internal passageway of said valve, said baffle being secured in position so that any fluid material approaching the interior surfaces of the valve from the interior of the container must strike and be redirected about said baffle before reaching the interior surfaces of the valve. The baffle reduces the severity of the shock load applied by said fluid material to the interior surfaces of said valve.

BACKGROUND ART

The use of self-closing discharge nozzles on packages for dispensing fluid materials is generally known in the art. For example, U.S. Pat. No. 2,071,657 issued to Richardson on Feb. 23, 1937 discloses a collapsible tube employing a self-closing nozzle employing a pair of self-closing jaws. The jaws, which are open to form an orifice in response to pressure of the fluid material, close off the discharge end of the tube when the pressure of the fluid material inside the container is relieved.

Another exemplary structure of this type is shown in U.S. Pat. No. 3,506,163 issued to Rauh et al. on Apr. 14, 1970. The patent to Rauh et al. discloses a collapsible container for a flowable material. The container includes a normally closed spout which opens automatically in response to a pressure increase inside the container. At the end of any given product dispensing cycle the spout automatically assumes its closed position, thus maintaining the flowable material within the container out of contact with the atmosphere as well as preventing the container from expanding back to its initial volume. The container of Rauh et al. is progressively collapsed as the flowable material is dispensed.

Packages with self-sealing fitments which eliminate the need for a conventional closure intermediate dispensing cycles are also generally known in the art. For example, U.S. Pat. No. 2,175,052 issued to Bull et al. on Oct. 3, 1939 discloses a dispensing closure for attachment to containers for materials such as toothpaste, shaving cream, etc. to which internal pressure is applied to discharge the contents therefrom.

Another prior art container closure of the self-sealing variety is disclosed in U.S. Pat. No. 1,825,553 issued to Smith on Sept. 29, 1931. Smith discloses a collapsible tube which is preferably soft and flexible and may serve as a receptacle for dentifrice, shaving cream, paste or other viscous substances. To extrude contents from the tube Smith discloses that it is only necessary, after the cap has been removed, to apply pressure to the tube and this pressure will force the contents of the tube against the top of the cavity of the closure and cause the valve slit to open and allow the tube contents to pass out as shown in FIG. 3. When the pressure on the tube is released, the elasticity of the closure member allegedly forces the slit tightly closed and prevents any further extrusion of the contents.

A greatly improved self-sealing fluid or fluidized material dispensing package is disclosed in commonly assigned British Patent Application No. 2,158,049A published on Nov. 6, 1985 in the names of James Lee Drobish and Leo Edward Taske and entitled SELF-SEALING DISPENSING VALVE, said commonly assigned British Patent Application being hereby incorporated herein by reference. The aforementioned commonly assigned British Patent Application discloses a resiliently deformable container having at least one discharge orifice. The orifice includes a resiliently deformable diaphragm valve having a portion exhibiting a generally concave shape. The valve is sealingly secured to the container across its orifice. The diaphragm valve is oriented so that it is normally inwardly concave in relation to the container. The concave shaped portion of the diaphragm valve includes at least one slit, preferably passing through the center of the discharge orifice of the container in a substantially straight line. The discharge orifice preferably comprises a container neck and the concave shaped portion of the diaphragm valve is preferably comprised of a resilient material with a low flexural modulus, such as silicone rubber, polyvinyl chloride, urethane, ethylene vinyl acetate, styrene butadiene copolymer or the like. The resiliently deformable container is preferably comprised of a resilient material with a somewhat higher flexural modulus such as polyethylene, polypropylene, polyvinylchloride, polyethylene terepthalate or the like.

In a particularly preferred disclosed embodiment of the Drobish and Taske package a snap-on auxiliary sealing member having a size and shape which substantially coincides with the outermost surface of the concave shaped portion of the valve is employed in an attempt to prevent actuation or opening of the concave shaped portion of the valve until the storage and dispensing package has been delivered to an placed in service by the consumer. In an alternative embodiment, the diaphragm valve is provided to the consumer without a slit, and the consumer is given directions on how to provide the slit by means of a knife or razor blade. In still another embodiment, a line of weakening is provided in the diaphragm valve such that upon the application of manual force to the valve by the consumer, the line of weakening ruptures to form a slit in the concave shaped portion of the valve.

Although storage and dispensing packages of the type disclosed in the aforementioned commonly assigned British Patent Application of Drobish and Taske have performed admirably well once they reach the consumer, some difficulties have been experienced on package embodiments using the pre-cut valves. In particular, unwanted discharge of product has been observed when the packages are subjected to sudden impact loads and/or compressive loads during transit, such as when a case of product is dropped or when it is subjected to a clamping operation in a warehousing or shipping operation. The impact and/or compressive loads experienced in transit or handling are often sufficient to cause the pre-cut valves to undergo momentary inversion, thereby dislodging the auxiliary sealing member and discharging a quantity of product through the valve. This causes damage and mess to the package and shipping case prior to its even reaching the retailer, let alone the end user. Such unintentional discharge or product from one package may also contaminate a number of the surrounding packages in the same or even adjacent shipping cases, thereby aggravating the severity of the loss.

While it is believed that such premature discharge of product can in most instances be avoided by shipping the package without precutting the slit or slits in the concave portion of the valve, this means that the consumer must either cut the concave shaped portion to create the slit or rupture the concave shaped portion along a predetermined line of weakening. These approaches are not only inconvenient to the consumer, but if the valve cutting or rupturing operation is not properly performed, it can destroy the highly desirable operating characteristics of the valve.

OBJECTS OF THE INVENTION

Accordingly, it is an object of the present invention to provide a storage and dispensing package for fluid or fluidized material which preserves the advantages of the flexible storage and dispensing package described in the aforementioned commonly assigned British Patent Application of Drobish and Taske, yet which overcomes the aforementioned problems of inadvertent discharge of product, particularly during handling and transit operations.

It is a further object of the present invention to provide a bimodal storage and dispensing package for fluid or fluidized material, said package having a first mode of operation capable of storing said fluid or fluidized material without leakage when the package is subjected to unintentionally applied external forces, and a second mode of operation capable of dispensing the fluid or fluidized material when the package is subjected to external forces intentionally applied by the user.

It is another object of the present invention to provide such a bimodal storage and dispensing package wherein the second mode of operation is capable of automatically isolating substantially all of the fluid or fluidized material remaining in the package from the surrounding atmosphere as soon as the intentionally applied external forces are removed from the package, even when the package is stored with its discharge orifice downwardly oriented between dispensing cycles.

It is still another object of the present invention to provide such a bimodal storage and dispensing package, which, in its second mode of operation, will permit single-handed dispensing of fluid or fluidized material whenever the package is squeezed sufficiently to raise the pressure inside the container above the threshold opening pressure of the valve.

It is another object of the present invention to provide such a package which will automatically cease the dispensing operation as soon as the squeezing forces are removed from the package.

It is still another object of the present invention to provide such a bimodal storage and dispensing package which is simple and economical to manufacture, yet highly reliable for its intended purpose.

DISCLOSURE OF THE INVENTION

In a particularly preferred embodiment, the present invention comprises a bimodal flexible storage and dispensing package for fluid or fluidized material. The package has a first mode of operation capable of storing the fluid or fluidized material without leakage when the package is subjected to unintentionally applied external forces and a second mode of operation capable of dispensing the fluid or fluidized material whenever the package is subjected to external forces intentionally applied by the user. In the second mode of operation the package is capable of dispensing the fluid or fluidized material through a discharge orifice in response to manually applied forces and of automatically ceasing the dispensing operation whenever the manually applied forces are removed. The package, in its second mode of operation, is also resistant to leakage when stored with its discharge orifice downwardly oriented intermediate dispensing cycles.

A bimodal storage and dispensing package of the present invention preferably comprises a resiliently deformable container for housing the fluid or fluidized material. The container, which includes a discharge orifice, exhibits a degree of flexibility sufficient to permit deformation thereof in response to manual forces applied thereto and a degree of resilience sufficient to return automatically to its undeformed condition whenever the manually applied forces are removed.

A self-sealing dispensing valve which, in the second mode of operation, opens at a predetermined threshold pressure which is greater than the maximum hydraulic head pressure of the fluid material in the container when the orifice is downwardly oriented is secured across the container's discharge orifice. The valve has a centrally located portion comprised of resilient material, and exhibits a predetermined concave shape while in a substantially unstressed condition. The centrally located concave shaped portion of the valve is sealingly secured about its periphery to one end of a resilient annular side wall portion of the valve. The resilient annular side wall portion of the valve defines an internal passageway which places the interior surface of the concave shaped portion of the valve in fluid communication with the interior of the resiliently deformable container.

The other end of the resilient annular side wall portion of the valve is sealingly secured about its periphery across the discharge orifice of the container with the valve oriented relative to the discharge orifice so that the centrally located portion of the valve is inwardly concave when the container is in an undeformed condition.

The resilient, concave shaped portion of the valve includes at least one substantially linear slit extending through its thickness from its interior surface to its exterior surface. In the package's second mode of operation the concave shaped portion of the valve exhibits an ability to undergo inversion from an inwardly concave, sealed and leak-resistant position to an open, outwardly convex, unsealed position whenever manually applied forces increase the fluid pressure inside the container above the threshold opening pressure of the valve. Fluid material is discharged from the container in said second mode of operation through the slit or slits in the valve whenever the manually applied forces on the container raise its internal pressure above the threshold opening pressure of the valve. The valve further exhibits an ability to automatically cut off the discharge of fluid material by returning to an inwardly concave, sealed and leak-resistant position whenever the manually applied forces are removed from the container.

The present invention, in its first mode of operation, includes valve restraining means to prevent the concave shaped portion of the valve from undergoing inversion when the package is subjected to unintentionally applied external forces, particularly suddenly applied external forces. The valve restraining means preferably comprises a first peripheral restraint means for applying a radially oriented compressive force about the periphery of the concave shaped portion of the valve. This first peripheral restraint means tends to place the concave shaped portion of the valve in a state of radial compression whenever a package of the present invention is in its first mode of operation. The valve restraining means further includes a second exterior surface restraint means substantially coinciding with at least a portion of the exterior surface of the concave shaped portion of the valve.

Together, the first peripheral restraint means and the second exterior surface restraint means prevent inversion of the concave shaped portion of the valve whenever said package is in its first mode of operation. Fluid pressure applied at the point of joinder between the concave shaped portion of the valve and the annular side wall portion of the valve is resisted by the radially oriented compressive force applied by the first peripheral restraint means, while fluid pressure applied against the interior surface of the concave shaped portion of the valve is resisted by the second exterior surface restraining means.

In addition to the valve restraining means described in the preceding paragraphs, a bimodal storage and dispensing package of the present invention includes an annular side wall restraint means. Peak fluid pressure loadings applied against the interior surfaces of the valve can tend to distort and collapse the annular side wall portion of the valve into its internal passageway. In addition, if the valve securement member is overtorqued when it is applied to the container, the securement flange of the valve can be squeezed and distorted out of its intended position. This distortion and collapse can, in extreme cases, dislodge the valve from its securement member. This tendency to collapse the annular side wall portion of the valve is resisted by an annular side wall restraint means of the present invention. Unlike the valve restraining means described in the preceding paragraphs, the annular side wall restraint means is functional in both the first mode of operation and the second mode of operation of the package.

The annular side wall restraint means preferably comprises an annular cylindrical member having an outside diameter substantially equal to the inside diameter of the internal passageway of the valve. The annular side wall restraint means is preferably secured in fixed relation to the discharge orifice of the container so that it extends through the internal passageway formed by the annular side wall portion of the valve in the area of the seal between the valve and the discharge orifice of the container.

In a highly preferred embodiment of the present invention, the bimodal storage and dispensing package further includes a baffle oriented substantially perpendicular to the axis of the internal passageway of the valve. The baffle is preferably secured in fixed relation to the discharge orifice of the container in the path of fluid communication between the interior surface of the concave shaped portion of the valve and the interior of the container. The baffle is preferably positioned so that any fluid material approaching the interior surface of the concave shaped portion of the valve from the interior of the container must strike and be redirected about the baffle before reaching the interior surface of the concave shaped portion of the valve. This greatly reduces the severity of any shock load applied by the oncoming fluid material to the interior surface of the concave shaped portion of the valve.

In a particularly preferred embodiment of the present invention the aforementioned baffle is secured to the annular side wall restraint means used to prevent collapse of the annular side wall portion of the valve into its internal passageway.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE PRESENT INVENTION

Figure 1:
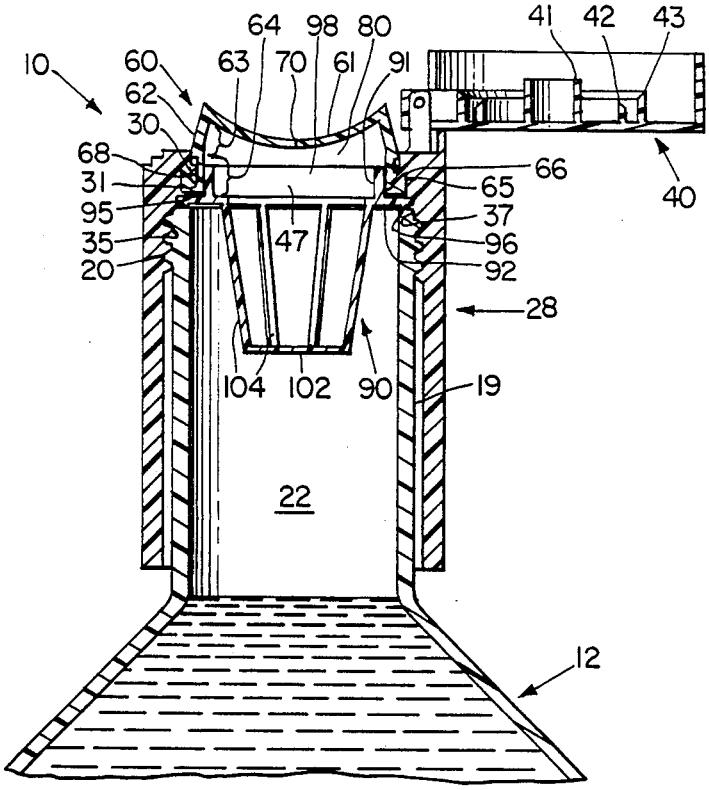
FIG. 1 is a simplified partial cross-sectional view of a particularly preferred embodiment of a bimodal storage and dispensing package of the present invention with the valve restraining means shown in the package's second mode of operation.

FIG. 1 is a greatly enlarged, simplified, partial cross-sectional view of a particularly preferred embodiment of a bimodal storage and dispensing package 10 of the present invention. The illustrated package preferably comprises a resiliently deformable container 12 such as a blow molded plastic bottle comprised of any of several materials well known in the art, e.g., polypropylene, polyethylene polyvinylchloride or the like. The particular material of construction chosen for any given application will, in general, be determined by such factors as product compatibility, cost, permeability and the like. The critical parameter is that the resiliently deformable container 12 exhibit a degree of flexibility sufficient to permit manual deformation of the container to extrude product through dispensing valve 60, and a sufficiently strong predeposition to return to its undeformed condition when external forces are removed that it will create a substantially instantaneous pressure drop inside the container. this substantially instantaneous pressure drop assists closure of the self-sealing dispensing valve 60 in use.

Figure 5:
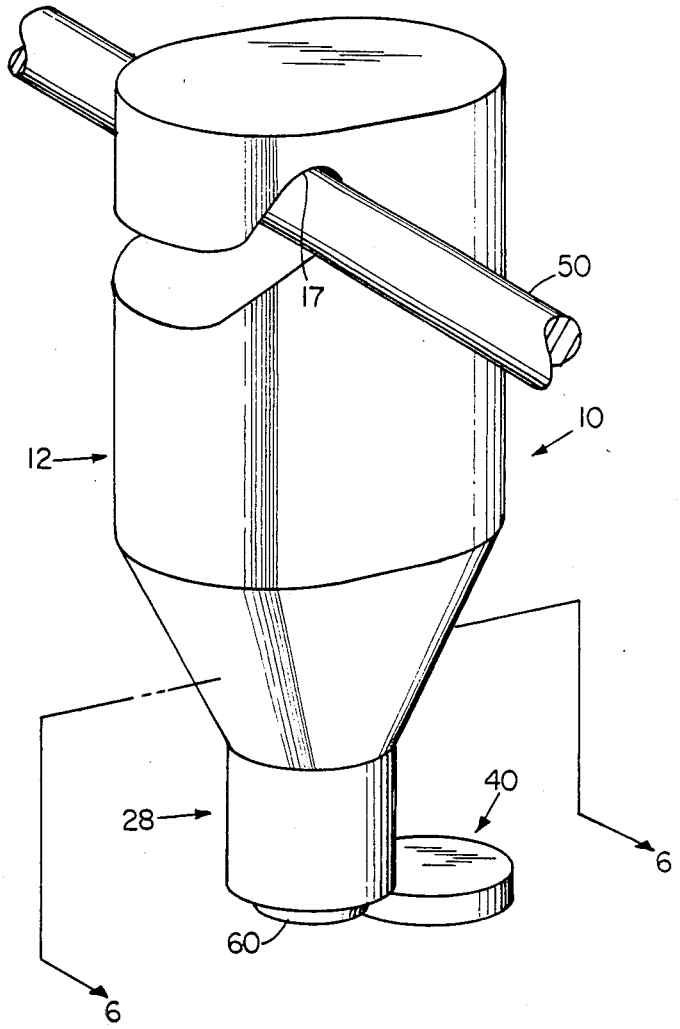
FIG. 5 is a simplified perspective view of the bimodal storage and dispensing package of FIG. 1 suspended in an inverted position from a stationary support such as a towel rack, said view showing the package in its second mode of operation.
Figure 6:
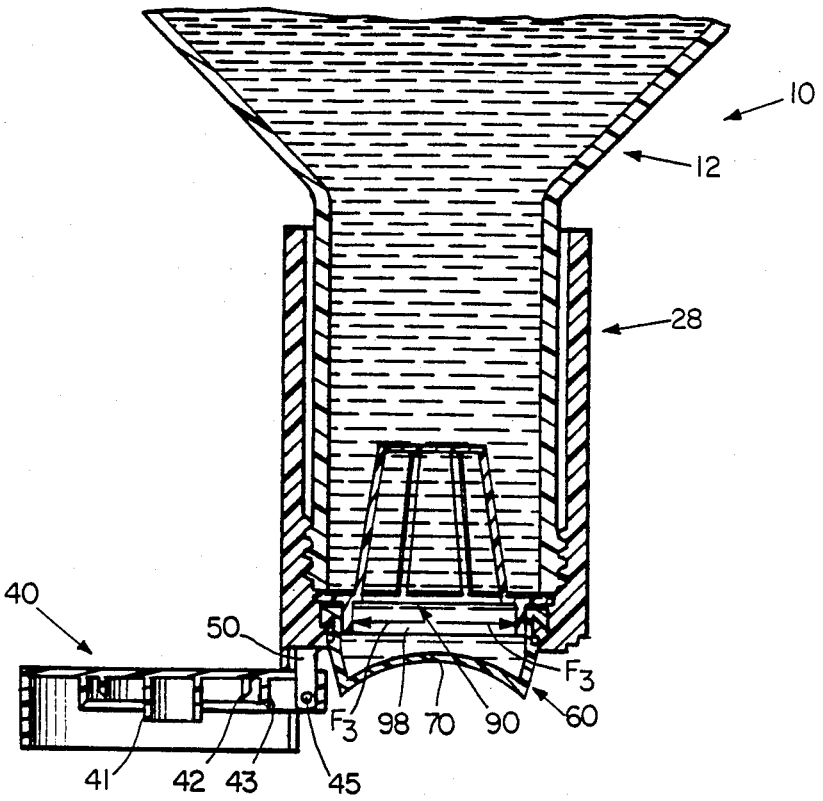
FIG. 6 is a greatly enlarged simplified partial cross-sectional view of the package of FIG. 5 taken through section line 6—6 of FIG. 5, said package being shown prior to the application of any external forces to the container.
Figure 7:
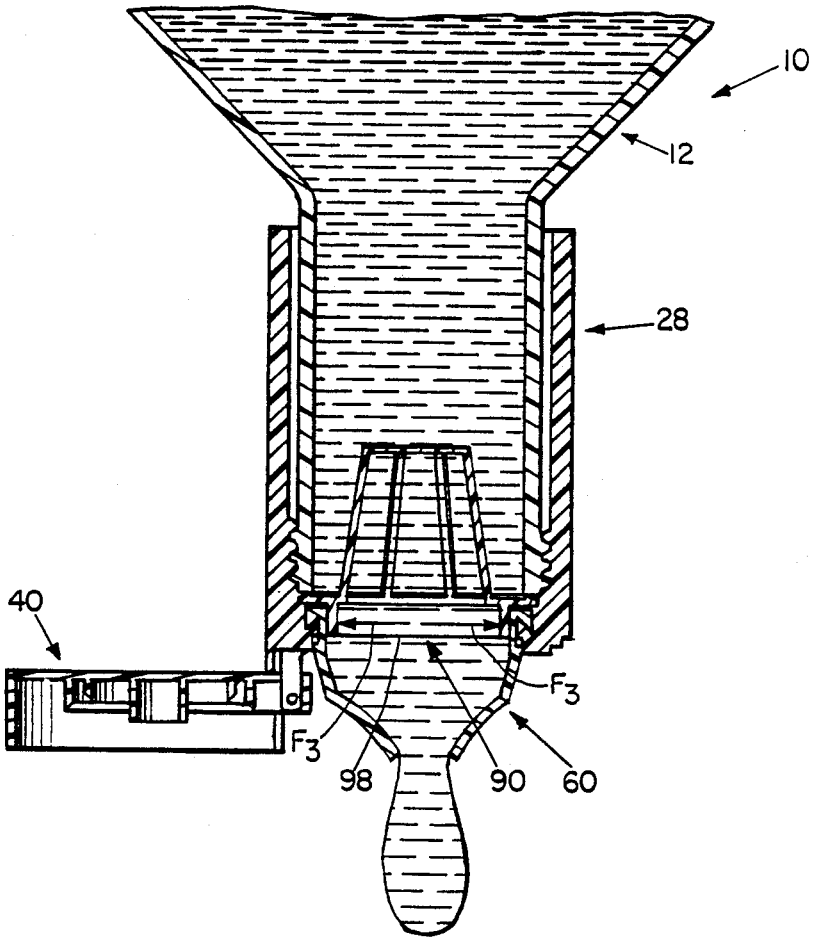
FIG. 7 is a view generally similar to that of FIG. 6, both illustrating the condition of the package and the valve when the threshold pressure of the valve has been exceeded by the fluid material inside the container and fluid material is in the process of being dispensed.
Figure 8:
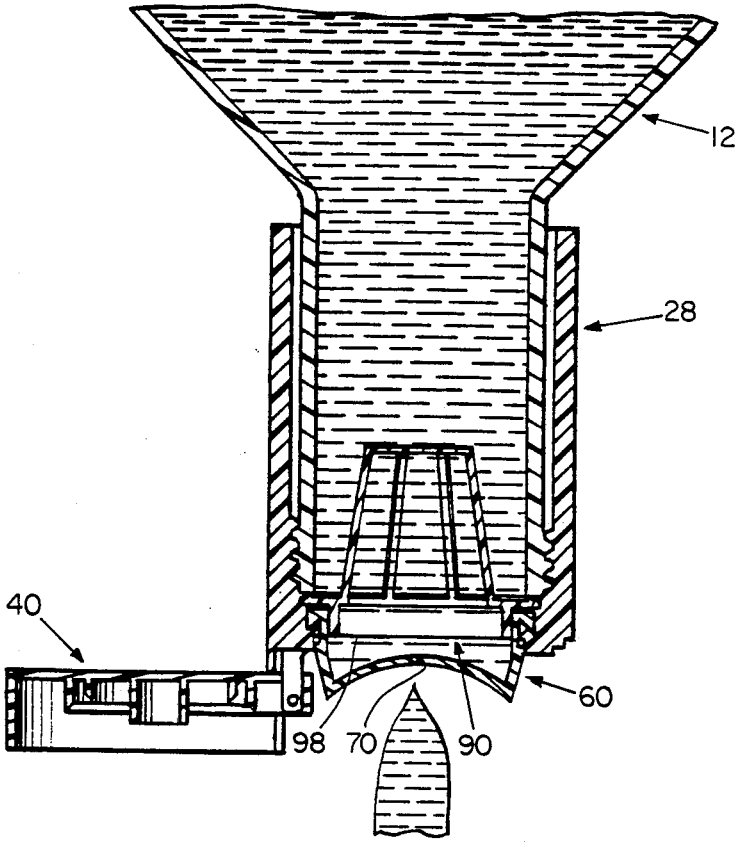
FIG. 8 is a view generally similar to that of FIG. 7, but illustrating the condition of the package and the valve immediately after the externally applied forces have been removed from the container and the valve has auto-matically returned to its inwardly concave, sealed and leak resistant position.

In the embodiment illustrated in FIG. 1, the resiliently deformable container 12 comprises a plastic bottle having a neck portion 19 which forms a discharge orifice 22 along its interior surface. The lowermost portion of the container 12 is preferably provided with some type of feature which will permit inverted hanging of the container from a support member, such as a towel rack 50, as generally shown in FIG. 5. In the embodiment illustrated in FIG. 5, this takes the form of a recessed notch 17 having the general shape of a hook. It is of course recognized that the particular means employed for suspending the container 12 in an inverted position in use may be integral with the container or applied as an external attachment, e.g., as a hook rotatably secured to the bottom of the container. The particular means chosen will be determined by the particular considerations of use.

As an alternative to suspending the container in an inverted position, the container could be provided with an overcap designed to permit standing the container in an inverted position. In still another embodiment, the container could be provided with an extended bottom wall which forms a recessed base for standing the container on a horizontal surface, and the dispensing valve 60 located in the container's bottom wall. Whatever means is chosen, storing the container with the dispensing valve 60 at its lowermost end not only eliminates product drain time from one end of the container to the other during dispensing, but also facilitates complete emptying of the container's contents.

As can be seen from FIG. 1, the neck portion 19 of the container 12 is preferably provided with suitable securement means, such as a helical thread 20 which, in conjunction with a complementary helical thread 35 on valve securement member 28, can be used to secure the valve securement member to the neck portion 19 of the container 12. The particular means of securement between valve securement member 28 and the container neck portion 19 is noncritical and may comprise, for example, a snap joint, a welded joint, an adhesively secured joint or even integral formation.

Dispensing valve 60 preferably comprises a concave shaped portion 61 sealingly secured about its entire periphery to one end of an annular side wall portion 62 which may be of uniform or varying diameter and thickness along its length. In the embodiment illustrated in FIG. 1, the annular side wall portion 62 is of varying diameter along its length and is comprised of a tapered portion 63 and a substantially straight walled portion 64. The end of the annular side wall 62 which is not secured to the concave shaped portion 61 preferably includes an outwardly projecting flange 65. The flange 65 is preferably of increasing thickness at some point intermediate its intersection with the straight walled portion 64 of annular side wall 62 and its outermost edge. In the embodiment illustrated in FIG. 1, the flange tapers from a minimum thickness at its point of intersection with straight walled portion 64 of annular side wall 62 to a maximum at its outermost edge. The tapered thickness of flange 65 helps to retain the valve 60 secured across the discharge orifice 22 of the container 12. In particular, valve securement member 28 includes an inwardly projecting flange 30, the lowermost surface of which includes a complementary taper which increases to a maximum thickness at its innermost and lowermost edge 31. When valve 60 and valve securement member 28 are assembled in the manner illustrated in FIGS. 1, 1A, 2 and 2A, the uppermoste surface of the tapered flange 65 on the valve and the lowermost surface of the tapered flange 30 on the valve securement member tend to interlock with one another in the manner shown in FIG. 1.

Figure 9:
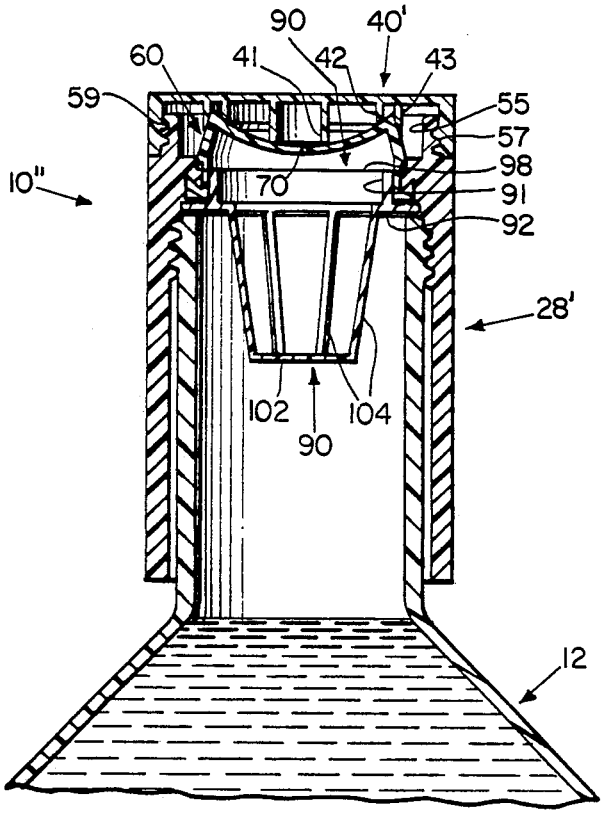
FIG. 9 is a partial cross-sectional illustration of an alternative bimodal storage and dispensing package of the present invention wherein the valve restraining means is secured in position by means of mating screw threads.

As will be appreciated from a review of commonly assigned British Patent Application No. 2,158,049 published on Nov. 6, 1985 in the names of James Lee Drobish and Leo Edward Taske and entitled SELF-SEALING DISPENSING VALVE, which commonly assigned British Patent Application has been incorporated herein by reference, the self-sealing dispensing valve 60 and resiliently deformable container 12 used in the present inventionc an, with the exception of minor differences in the method of securement of the valve across the discharge orifice, be generally the same as the self-sealing dispensing valve and reseliently deformable container disclosed in FIG. 9 of said commonly assigned British Patent Application. The self-sealing dispensing valve 60 used in the present invention is preferably comprised of a resilient material, which may be an elastomer such as silicone rubber, and is preferably formed by injection molding. Another viable categor of materials from which dispensing valve 60 can be formed comprises thermoplastic elastomers. Still other exemplary resilient materials well known in theart which may be employed for dispensing valve 60 include polyvinylchloride, urethane, ethylene vinyl acetate, styrene butadiene copolymer and the like.

In the valve embodiment illustrated in FIG. 1, a substantially linear slit 70, which extends from the innermost to the outermost surface of the concave shaped diaphragm portion 61 of the valve is provided. Substantially linear slit 70 is preferably so positioned that is passes through the center of the valve 60, which in turn is so positioned across the discharge orifice of the container that the center of the valve 60 substantially coincides with the axis of the circular neck portion 19 of the container 12.

As has been pointed out in the BACKGROUND portion of the present specification, when flexible storage and dispensing packages of the type generally disclosed in the aforementioned commonly assigned British Patent Application of Drobish and Taske are subjected to unintentional external loading, such as occurs when a shipping case containing a multiplicity of these packages is dropped or when it is subjected to a clamping operation, the concave shaped portion of the dispensing valve may be inverted by the surge of fluid pressure exerted against its interior surface. In some instances the interior passageway formed by the annular side wall portion of the valve may also undergo collapse upon itself as the valve undergoes distortion in an attempt to relieve the increase in pressure. While snap-on auxiliary sealing members of the type disclosed in the aforementioned commonly assigned British Application of Drobish and Taske can resist some degree of impact and/or compressive loading and prevent unwanted discharge of product, it has been observed that the impact and/or compressive loadings actually experienced in routine handling and transit operations are sometimes sufficient to dislodge the snap-on auxiliary sealing member and discharge product. This can result in damage not only to the package or packages directly experiencing the unintentional external loading, but also to neighboring packages and even neighboring cases of product.

The present invention solves many of the damage and mess problems associated with such packages by providing novel structure which permits a first mode of operation in which the vast majority of shock loadings applied to the itnerior surfaces of the valve are resisted without causing either damage to the package or unwanted discharge of product. In addition, this novel structure permits a second mode of operation which preserves the extremely desirable opening and closing characteristics exhibited by flexible packages of the type generally disclosed in the aforementioned commonly assigned British Patent Application of Drobish and Taske.

In particular, to prevent inversion of the concave shaped portion 61 of the valve in response to suddenly applied impact loadings of fluid against the interior surfaces of valve 60, valve restraint means which not only resist inversion of the valve by means of physical contact with its outermost surface, but which also place the concave shaped portion 61 of the valve in a state of radial compression whenever the package is in its first mode of operation are provided. The package embodiment 10 is in its first mode of operation when the valve restraining member 40 is in the fully closed position shown in FIG. 2. When the valve restraining member 40 is in its fully open position, as shown in FIG. 1, the package is in its second mode of operation.

Figure 1A:
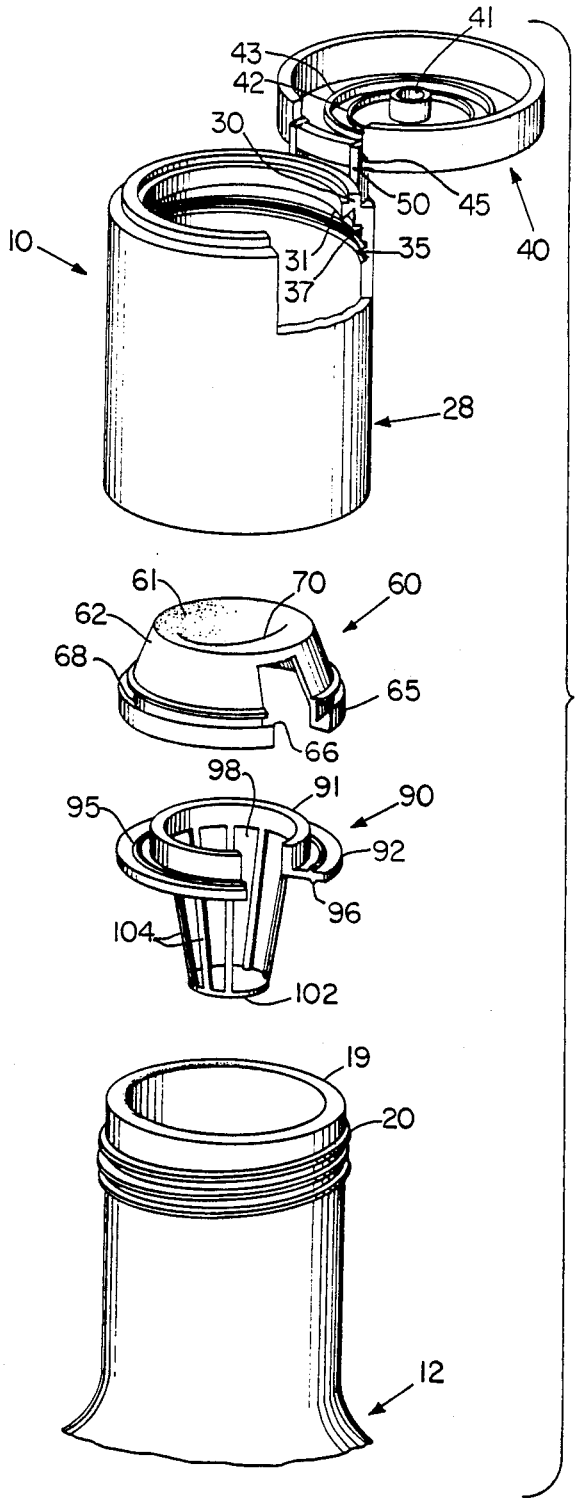
FIG. 1A is a simplified exploded perspective view of a bimodal storage and dispensing package of the type shown in FIG. 1.
Figure 2:
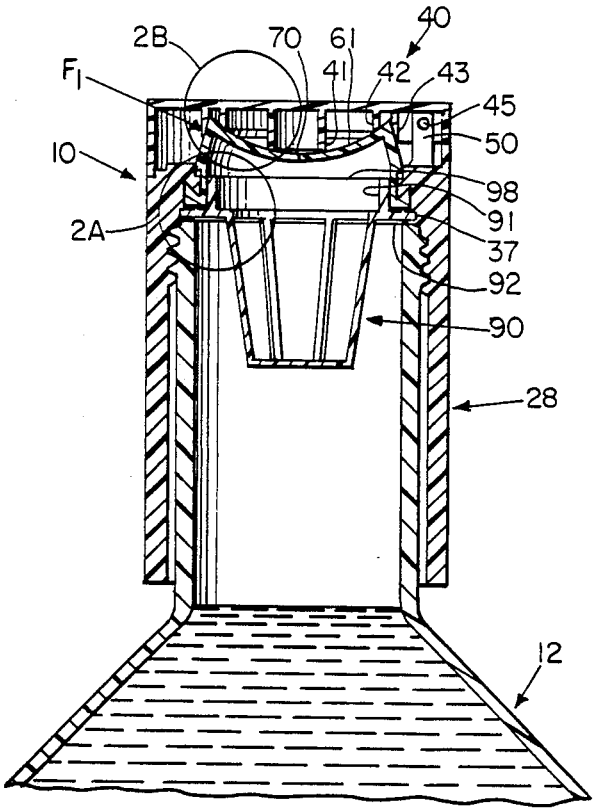
FIG. 2 is a simplified partial cross-sectional illustration of the bimodal storage and dispensing package of FIG. 1 with the valve restraining means shown in the package's first mode of operation.
Figure 2A:
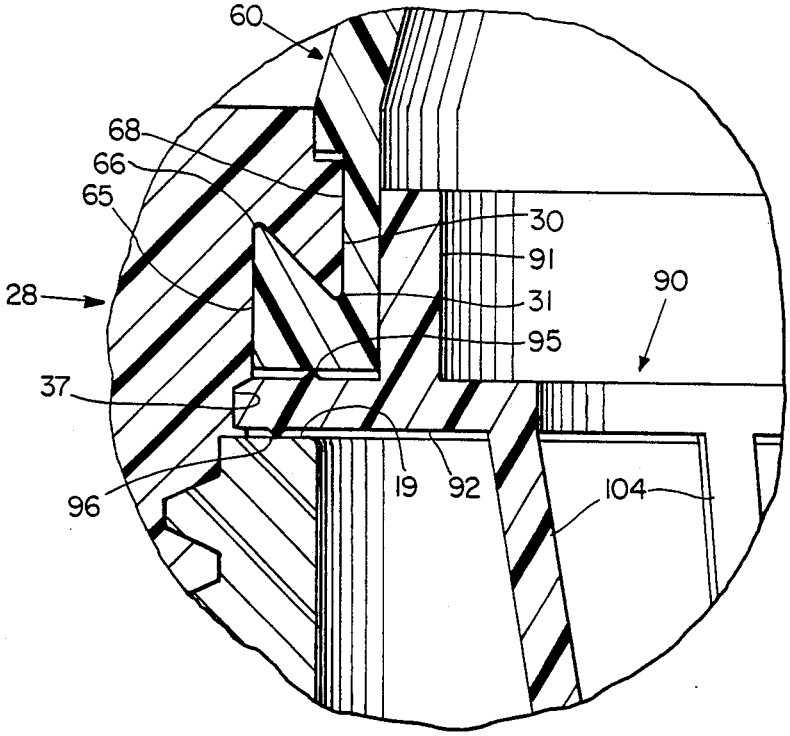
FIG. 2A is a greatly enlarged view of the inset 2A shown in FIG. 1.

As can be seen from FIGS. 1, 1A and 2, valve restraining member 40 is hingedly connected to valve securement member 28 by means of a pivot pin 45 carried by support member 50 which is preferably integrally formed with valve securement member 28. Valve restraining member 40, which s typically comprised of a molded plastic, such as polyethylene or polyvinyl chloride, preferably includes an exterior surface restraint means substantially coinciding with at least a portion of the exterior surface of the concave shaped portion 61 of the dispensing valve. In the embodiment shown in FIGS. 1, 1A and 2, the exterior surface restraint means comprises a pair of concentric annular rings which are integrally molded with valve restraining member 40.

Figure 2B:
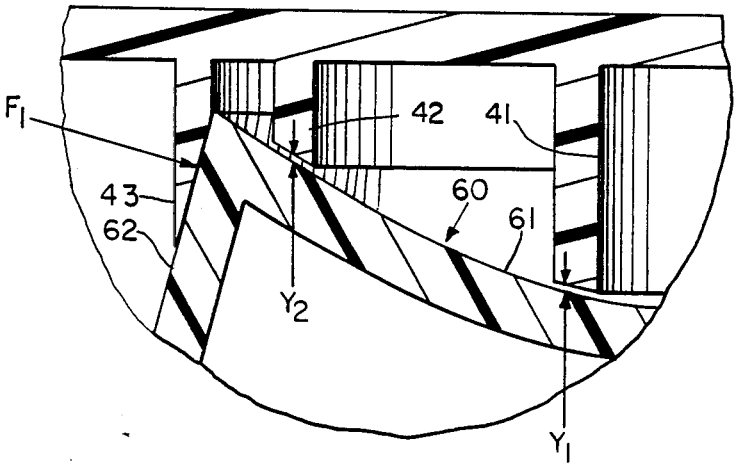
FIG. 2B is a greatly enlarged view of the inset 2B shown in FIG. 2.

In the package embodiment illustrated in FIG. 2B, the innermost such ring 41 is of greater overall height than the outermost concentric ring 42, which is located just inside the outermost edge of the hemispherical portion 61 of the valve. Ideally, the lowermost surface of each concentric ring is positioned and shaped so that the lowermost surfaces of concentric rings 41 and 42 which are adjacent the valve do not deform the concave shaped portion 61 of the valve when the valve restraining member 40 is in the fully closed position shown in FIG. 2.

The vertical clearance between ring 41 and the uppermost surface of the concave shaped portion 61 of valve 60 is depicted as $Y_1$ in FIG. 2B, while the vertical distance between ring 42 and the uppermost surface of the concave shaped portion 61 of valve 60 is depicted as $Y_2$. The optimum amount of vertical clearance between the uppermost surface of the concave snaped portion 61 of the valve 60 and the lowermost surfaces of rings 41 and 42, as defined by vertical distances $Y_1$ and $Y_2$, respectively, may vary depending upon such factors as the resilience of the valve 60, the particular geometry of the valve and the valve restraining member 40, the length and orientation of the valve slit or slits 70 and the viscosity of the fluid material to be dispensed. If the slit 70 is sufficiently long that it will make contact with rings 41 and 42 when the valve attempts to deform in response to a shock or compressive loading such as might be caused by dropping or unintentionally squeezing either an individual package 10 or a case of packages, it has in many instances been found desirable to permit a limited degree of valve movment to prevent stress concentration from occurring at the points of contact with rings 41 and 42. The degree of valve movement permitted must not, however, be so great as to permit inversion of the concave shaped portion 61 of the valve 60.

Figure 2C:
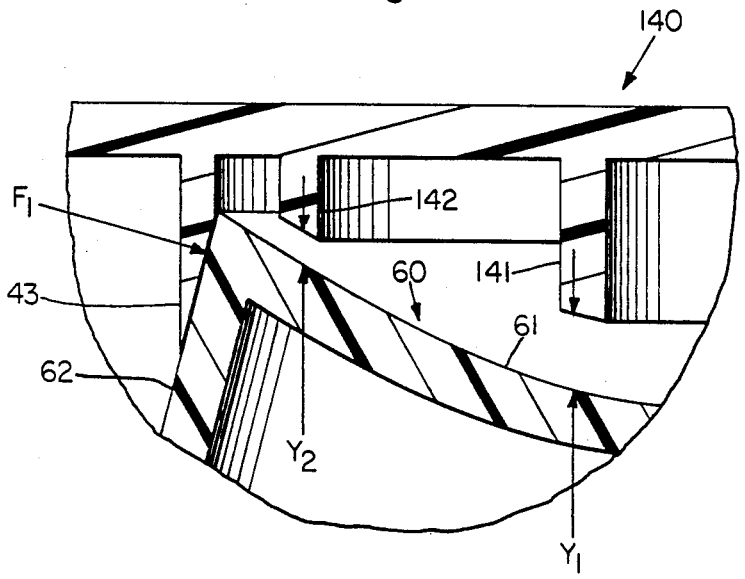
FIG. 2C is a greatly enlarged view generally similar to that of FIG. 2B, but showing an alternative embodiment of a valve restraining member intended to permit greater flexing of the valve when the package is subjected to sudden impact or unintentionally applied compressive loadings.
Figure 3:
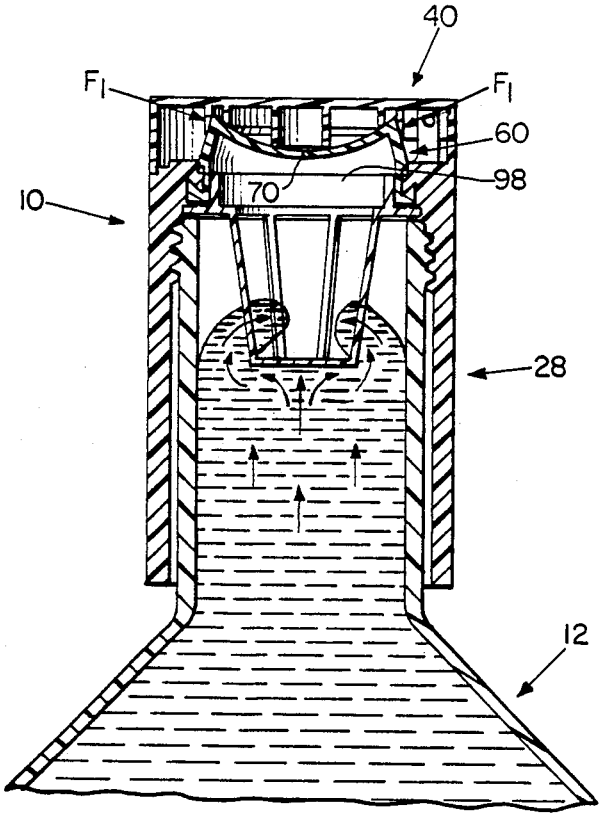
FIG. 3 is a simplified partial cross-sectional illustration of the bimodal storage and dispensing package of FIG. 2 illustrating the initial effect of the baffle upon an upward surge of fluid material caused by a sudden increase of pressure within the container.

In the alternative valve restraining member 140 shown in FIG. 2C, the vertical clearances $Y_1$ and $Y_2$ have been increased over those used in valve restraining member 40 shown in FIG. 2B to permit a greater degree of movement in the concave shaped portion 61 of the valve 60. As will be apparent from a comparison of FIGS. 2B and 2C, the increase in vertical clearance $Y_1$ between the lowermost surface of ring 141 and the concave shaped portion 61 of the valve 60 is much greater than the increase in vertical clearance $Y_2$ between the lowermost surface of ring 142 and the concave shaped portion 61 of the valve 60. It will therefore be understood that the optimum vertical clearances $Y_1$ and $Y_2$ for any particular valve and restraining member are preferably established independently of one another.

In the embodiment shown in FIG. 2C, the concave shaped portion 61 of valve 60 can expand to a condition just short of becoming planar before it contacts the lowermost surfaces of rings 141 and 142. Allowing the entire concave shaped portion 61 of valve 60 to undergo a greater degree of expansive movement reduces the chance of localized deformation of specific portions of the valve which could otherwise allow localized opening of the slit 70 adjacent its points of contact with the annular restraining rings. It will, of course, be understood that additional rings could be added to provide additional restraint for the valve in the event the two rings shown in the illustrated embodiment fail to prevent unwanted discharge of fluid.

As will be appreciated by those skilled in the art, concentric rings 41 and 42 on valve restarining member 40 and concentric rings 141 and 142 on valve restraining member 140 act in a manner generally similar to the concave shaped portion of the snap-on auxiliary sealing member disclosed in the commonly assigned British Patent Application of Drobish and Taske. However, as has been pointed out in the preceding paragraphs, valve restraining members of the present invention, unlike the valve restraining member of Drobish and Taske, also include means for placing the concave shaped portion 61 of the valve 60 in a state of radially applied compression when a bimodal storage and dispensing package of the present invention is in its first mode of operation. This is preferably accomplished by means of a third concentric annular ring 43 which exhibits an interior diameter slightly greater than that of the uppermost surface of the concave shaped portion 61 of the valve. In addition, the lowermost surface of annular ring 43 is preferably tapered at an angle substantially coinciding with the angle of taper of tapered section 63 of the annular side wall portion 62 of valve 60. Unlike annular rings 41 and 42 shown in FIG. 2B and annular rings 141 and 142 shown in FIG. 2C, annular ring 43 is sized and configured so as to produce a slight degree of interference between the tapered segment 63 of annular side wall protion 62 whenever a valve restraining member of the present invention is in its fully closed position, as illustrated in FIGS. 2B and 2C. As a result of this slight interference, a radially oriented compressive force $F_1$ is exerted about the periphery of the concave shaped portion 61 of the valve whenever a valve restraining member of the present invention is in its fully closed position.

Because the radially oriented force $F_1$ applied about the periphery of the valve 60 by peripheral restraining ring 43 will continue to increase as the concave shaped portion 61 attempts to approach a planar condition, the increased compression in the concave shaped portion of the valve will tend to seal the slit or slits 70 more tightly together as teh concave shaped portion 61 of valve 60 attempts to reach a planar condition. This in turn helps to prevent unwanted discharge of fluid through the slit in response to shock or unintentional compressive loadings applied to the package.

As will be appreciated by those skilled in the art, the compressive force $F_1$ exerted by outermost annular ring 43 against the outermost surface of valve 60 has the effect of forming a seal which traps the air contained within the area of the valve restraining member located interiorly of annular ring 43 and the uppermost surface of the concave shaped portion 61 of valve 60. When the concave shaped portion 61 of the valve 60 is permitted to undergo limited movement in response to a shock or unintentional compressive loading applied to the package 10, the air trapped within the aforementioned area undergoes compression. Depending upon the volume of air initially trapped within this area and the degree of compression experienced in response to the shock or unintentional compressive loading applied to the package, there is sometimes a tendency for the valve restraining member to become dislodged. This tendency is particularly pronounced in those embodiments wherein the valve restraining member is only hingedly connected to the valve securement member 28.

Figure 11:
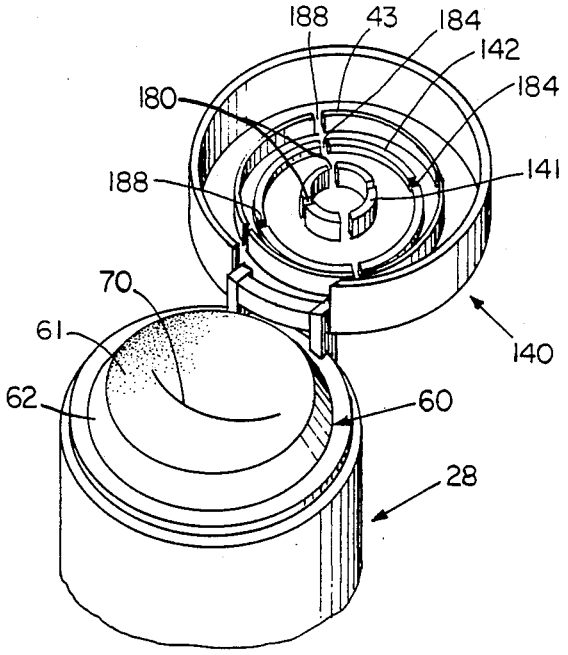
FIG. 11 is a partial perspective illustration of a bimodal storage and dispensing package of the present invention, said package including vent means for the air which would otherwise be trapped between the concave shaped portion of the valve and the innermost surface of the valve restraining member whenever the valve restraining member is in its fully closed position.

The valve securement member 28 shown in FIG. 11, which is identical to valve securement member 28 shown in FIGS. 1–8, incorporates a valve restraining member 140 which permits the air which would otherwise be trapped between the uppermost surface of the concave shaped portion 61 of valve 60 and the portion of the valve restraining member 140 located interiorly of annular ring 43 to escape into a chamber formed in the outer regions of the valve restraining member 140. This venting of air from the inner to the outer chamber substantially reduces the tendency of the compressed air to dislodge the valve restraining member from its fully closed position. in the package embodiment shown in FIG. 11, vent means are provided between the inner and outer regions of the valve restraining member 140, i.e., the areas lying on opposite sides of annular ring 43. The vent means comprises a multiplicity of slotted vents 180 in innermost annular ring 141, a multiplicity of slotted vents 184 in secondary annular ring 142 and a multiplicity of slotted vents 188 in outermost annular ring 43. These slotted vents prevent the formation of a seal between the inner and outer regions of the valve restraining member 140 when the valve restraining member is in its fully closed position, as shown in FIG. 2C.

In the event the concave portion 61 of valve 60 undergoes limited movement due to unintentional external loading of the package shown in FIG. 11, the air immediately above the surface of the concave shaped portion of the valve is free to pass from the inner to the outer regions of the vale restraining member 140 through the slotted vents. Because of the relatively small volume reduction occassioned by limited movement of the concave shaped portion 61 of valve 60 compared to the much larger volume of air contained within the outer chamber of the valve restraining member 140, the degree of air compression which occurs due to external loading of the package is normally insufficient to dislodge the valve restraining member 140 from its fully closed position.

It is of course recognized that the slotted vent means disclosed in the package embodiment of FIG. 11 is but one preferred solution to the aforementioned air compression problem. Many other configurations of vents could be employed with equal facility. Furthermore, the inner regions of valve restraining member 140 could, if desired, be vented to atmosphere either directly inside annular ring 43 or indirectly outside of annular ring 43. The particular vent configuration employed is noncritical so long as the size of the vent or vents are large enough to permit substantially instantaneous venting of the air which would otherwise be compressed between the concave shaped portion 61 of valve 60 and that portion of valve restraining member 140 located interiorly of annular ring 43.

A valve restraining member of the present invention can be maintained in the positons illustrated in FIGS. 1 and 2 by many alternative means well known in the art. For example, the valve securement member 28 and the valve restraining member 40 may include mating lugs (not shown) which engage one another at one or more points about the periphery of the valve restraining member. Alternatively, the hinge mechanism selected to connect the valve restraining member 40 to the valve securement member 28 may include a detent (not shown) to maintain the valve restraining member in either position until the user decides to manually change it.

Quite surprisingly, it has been learned that even when the concave shaped portion 61 of valve 60 is maintained in a state of compression and the exterior surface of the concave shaped portion is prevented from inverting by means of concentric rings 41 and 42, as shown in FIG. 2, sudden impact loadings on the package can still cause damage and mess when the valve is secured across the discharge orifice in the manner generally disclosed in FIG. 9 of the aforementioned British Patent Application of Drobish and Taske. In particular, it has been observed that severe impact loadings on the interior surfaces of the valve caused by momentary surges of fluid pressure can still cause valves which are secured in position generally in accordance with the teachings of FIG. 9 of the aforementioned commonly assigned British Patent Application of Drobish and Taske to undergo extreme distortion in an attempt to relieve the pressure. In some cases this can cause the valve's annular side wall portion 62 to collapse into the valve's internal passageway 80 and become dislodges from the discharge orifice of the container.

The present invention overcomes problems associated with this aspect of sudden fluid impact loading on the valve by providing annular side wall restraint means to prevent that portion of the annular side wall which is sealingly secured across the discharge orifice of the container from collapsing inwardly upon the valve's internal passageway. In addition, the annular side wall restraint means of the present invention prevents the securement flange of the valve from being squeezed and distorted out of its intended position should the valve securement member happen to be overtorqued when it is applied to the container. In the embodiment illustrated in FIGS. 1 and 2 this is accomplished by providing an annular side wall restraint means 90 comprised of a hollow cylindrical member 91 having an outside diameter approximately equal to the inside diameter of the straight walled segment 64 of the annular side wall portion 62 of valve 60. The hollow cylindrical member 91, which is preferably comprised of a molded plastic material such as polyethylene or polyvinyl chloride, has an overall height sufficient to span that portion of the annular side wall 62 coinciding with inwardly directed flagne 30 of valve securement membe 28 as well as the cylindrical flange 65 of valve 60. The lowermost end of cylindrical member 91 is preferably secured to an outwardly directed flange 92 which, when installed, abuts the lowermost surface of flange 65 of valve 60. The center of the flange 92 includes a relatively large aperture 98 through which fluid may pass.

As can best be seen from the exploded view of FIG. 1A, annular side wall restraint means 90 is preferably inserted from the lowermost end of valve securement member 28 either concurrently with or after valve 60. Valve 60 is installed in position by means of an external peripheral groove 68 which is snapped over inwardly directed flange 30 on valve securement member 28. If the valve 60 and the annular side wall restraint means 90 are inserted concurrently, the hollow cylindrical member 91 which resides inside the straight walled portion 64 of annular side wall 62 helps to keep the valve and the annular side wall restraint means aligned with one another during the insertion process.

As can best be seen in FIGS. 1 and 2, flange 92 must be deformed slightly in order to be finally snapped into position in internal groove 37 of valve securement member 28. As can also be seen in FIGS. 1, 1A, 2 and 2A, the flange portion 92 of annular side wall restraint means 90 also includes a small raised boss 95 on its uppermost surface and a small raised boss 96 on its lowermost surface. These raised bosses help to estalish a fluid-tight seal between flange 65 of teh valve 60 and the uppermost surface of flange 92 of the annular side wall restraint means as well as between the lowermost surface of flange 92 and the uppermost or finish surface of the container neck 19. As will be appreciated by those skilled in the art, groove 37 in valve securement member 28 is preferably positioned relative to inwardly directed flange 30 so that a fluid-tight seal is formed between the uppermost surface of flange 92 and the lowermost surface of flange 65 whenever the innermost and lowermost edge 31 of inwardly directed flange 30 is seated in groove 68 of the valve and outwardly directed flange 92 is seated in groove 37 of the valve securement member. Accordingly, the only fluid tight seal which must be established when the completely assembled valve securement member 28 is applied to the container neck 19 is between the lowermost surface of flange 92 and the uppermost or finish surface of the container neck. This is identical to the requirement for applying a conventional closure to a container. Accordingly, reliable application of the completely assembled valve securement member 28 while valve restraining member 40 is in its fully closed position, as illustrated in FIG. 2, can be performed using conventional automated capping equipment without need for hypercritical control of application torque. Because flange 92 is restrained by groove 37 it prevents severe compression of the flange 65 of valve 60 even if the valve securement member 28 is torqued more than is necessary to establish a fluid tight seal between flange 92 and the finish surface of the container neck. This, in turn, helps to ensure uniform valve operational characteristics and leak resistance from one package to another, in addition, it helps to avoid squeeze out and distortion of the valve's securement flange 65 even if the valve securement member 28 happens to be overtorqued when it is applied to the container.

Figure 10:
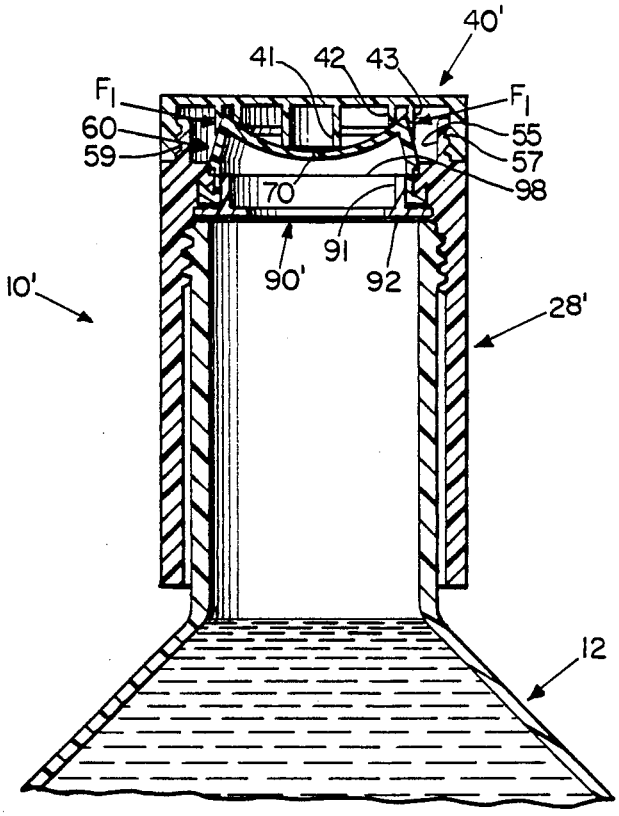
FIG. 10 is a partial cross-sectional illustration of still another embodiment of a bimodal storage and dispensing package of the present invention.

It has generally been observed in the practice of the present invention that valve restraining means and annular side wall restraint means of the type generally described in the preceding paragraphs are effective in overcoming the damage and mess problems caused by sudden impact loading in most situations where the valve restraining means is ecured in place by positive fastening means, e.g., as by complementary screw threads of the type disclosed in the bimodal storage and dispensing package embodiment 10' shown in FIG. 10.

As will be apparent from a comparison of the package embodiments of FIG. 10 and FIG. 2, wherein like reference numerals have been utilized for like elements, valve securement member 28' and valve restraining means 40' differ from valve securement member 28 and valve restraining means 40, respectively, only in their method of securement to one another. In particular, valve securement member 28' has been provided with an integrally formed upstanding collar 55 exhibiting a helical thread 57 on its outermost surface. Valve restraining means 40' is secured in the package's first mode of operation to valve securement member 28' by means of a continuous internal thread 59 complementary to thread 57 on valve securement member 28'. When the valve restraining means 40' is fully advanced into its closed position, as generally shown in FIG. 10, the fit between the concentric annular rings 41, 42 and 43 located on the interior of valve restraining means 40' on package embodiment 10' is identical to that for package embodiment 10 shown in FIG. 2.

Annular side wall restraint means 90' shown in package embodiment 10' of FIG. 10 comprises a cylindrical member 91 and an annular outwardly directed flange 92 identical to those employed in annular side wall restraint means 90 shown in FIG. 2. A centrally located aperture 98 is provided in the center of outwardly directed flange 92 identical to aperture 98 in side wall restraint means 90 shown in FIGS. 1-9.

However, annular side wall restraint means 90 and annular side wall restraint means 90' differ from one another in one important respect. Because of the severity of the shock loading which sometimes occurs against the interior surface of valve 60 due to the sudden application of external forces during shipping and handling, it has been observed that unless the valve restraining means is positively locked in position by high strength means, such as by screw threads as generally shown in package embodiment 10' of FIG. 10, it is still possible for the valve 60 to invert and dislodge the restraining means 40 from the totally closed position illustrated in FIG. 2 to an intermediate position somewhere between that shown in FIG. 2 and the fully opened position illustrated in FIG. 1. Note the application of restraining forces $F_2$ and $F_3$ by concentric rings 41 and 42, respectively, in response to suddenly applied fluid pressure within valve 60, as generally shown in FIGS. 4 and 4A.

Therefore, when it is desired to utilize a valve restraining means which is not secured in its fully closed position by high strength means such as screw threads, e.g., the hingedly connected valve restraining means 40 shown in FIG. 2, a baffle 102 oriented substantially perpendicular to the axis of internal passageway 80 of valve 60 is preferably secured in fixed relattion to the discharge orifice 22 of the container. As can be seen inpackage embodiment 10 of FIGS. 1 and 2, the baffle 102 may be secured by means of a multiplicity of struts 104 to the lowermost surface of flange 92. The baffle 102 is thereby positioned in the path of fluid communication between the interior surface of the concave shaped portion 61 of valve 60 and the interior of the container.

Any fluid material approaching the interior surface of the concave shaped portion 61 of the valve from the interior of the container must strike and be redirected about the baffle 102 before it can reach the interior surface of the concave shaped portion of the valve. This redirection is generally illustrated by the arrows in FIG. 3, which shows the column of fluid rising in response to an external force being suddenly applied to the container 12. Collapse of annular side wall portion 64 of valve 60 into internal passageway 80 is resisted about its entire periphery by a radially outwardly directed restraining force $F_4$, shown in FIG. 4, applied by hollow cylindrical member 91 of annular side wall restraint means 90. As can also be seen in FIG. 4, which shows the interior of valve 60 substantially filled with fluid, the baffle 102 serves to redirect the rising column of fluid into a myriad of different directions, thereby generating turbulence which helps to dissipate the momentum of the approaching fluid column. Accordingly, the severity of the shock loading against the interior surface of both the annular side wall portion 62 and the concave shaped portion 61 of valve 60 is reduced to a level which, in the majority of instances, is insufficient to dislodge the hingedly connected valve restraining means 40 from the fully closed position shown in FIG. 2.

Figure 4:
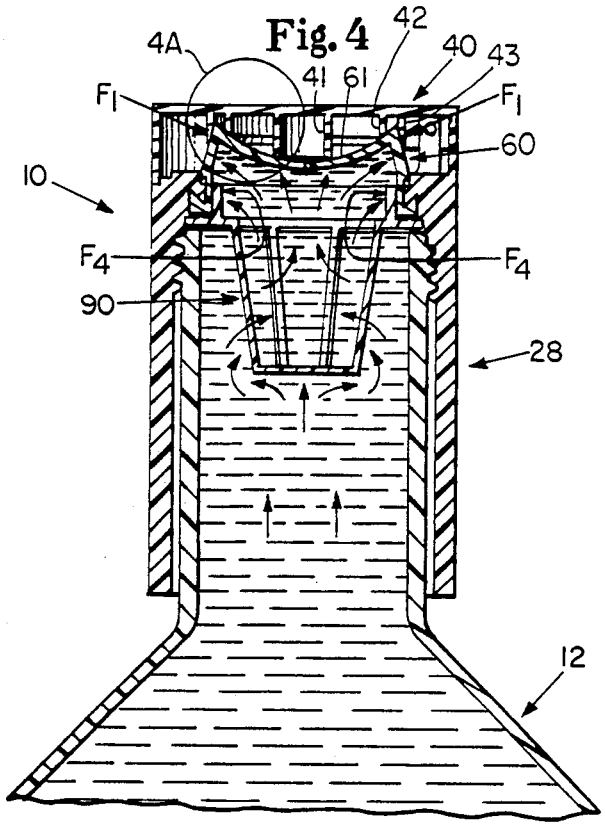
FIG. 4 is a simplified partial cross-sectional illustration generally similar to FIG. 3, but illustrating the situation which is created as the fluid material fills the interior of the valve in response to the sudden increase of pressure within the container.
Figure 4A:
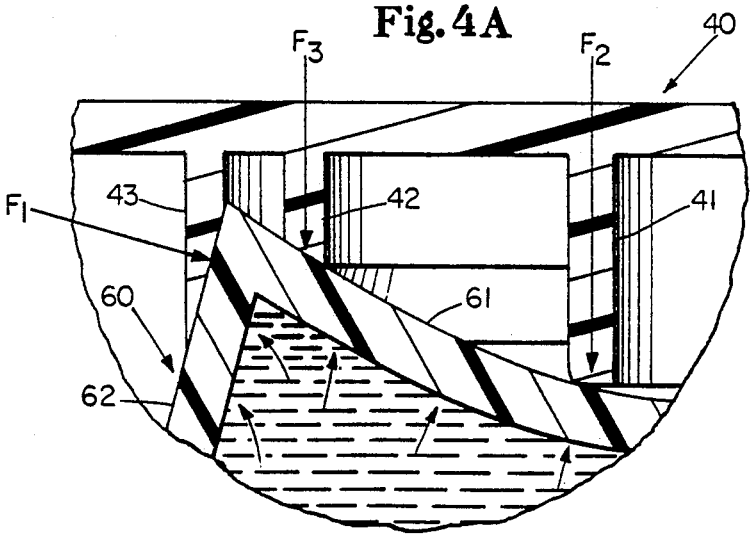
FIG. 4A is a greatly enlarged view of the inset 4A shown in FIG. 4.

So long as the valve restraining means 90 is not dislodged by the sudden application of fluid pressure inside the valve 60, the valve will remain in an inwardly concave, sealed and leak resistant position, as generally shown in FIG. 4.

To avoid negatively impacting upon the dispensing characteristics of the storage and dispensing packages of the present invention in their second mode of operation, the flow area existing between the multiplicity of struts 104 is preferably maintained so as to at least equal the total surface area of the interior of the concave shaped portion 61 of valve 60. If the flow area between the struts is much smaller than this, the quickness of the valve's closing upon release of forces from the container will be impaired. Accordingly, the preferred baffle 102 serves to redirect the flow of fluid approaching the valve from the interior of the container without substantially restricting it in either direction.

As will be appreciated from the foregoing description, baffle 102 may also be used in situations where the valve restraining means is secured in its closed position by high strength securement means. See, for example, package embodiment 10" of FIG. 9. However, baffle 102 finds greatest utility int hose situations where the valve restraining means is not secured in its fully closed position by high strength securement means, e.g., the hinged-top package embodment 10 shown in FIGS. 1–4. By using baffle 102 in conjunction with valve restraining and annular side wall restraining means, such as those generally disclosed in FIGS. 1–4, even hinged-top bimodal storage and dispensing packages of the present invention can be subjected to substantial shock loadings without dislodging the valve restraining member 40 from the fully closed position generally illustrated in FIGS. 2–4.

Accordingly, the present invention overcomes serious problems typically experienced when flexible storage and dispensing packages of the type generally disclosed in the commonly assigned British Patent Application of Drobish and Taske are subjected to sudden impact loadings, yet preserves all of the highly desirable operating characteristics of said packages.

While particular embodiments of the present invention have been illustrated and described, it will be obvious to those skilled in the art that various changes and modifications can be made without departing from the spirit and scope of the invention. For example, the present invention can also be practiced to advantage on packages employing self-sealing valves with multiple non-intersecting, substantially linear slits in their concave shaped portion. It is also believed that the present invention can be practiced to advantage on packages employing self-sealing valves with intersecting slits in their concave shaped portion. It is intended to cover in the appended claims all such modifications that are within the scope of this invention.

What is claimed is:

1. A flexible storage and dispensing package for fluid material, said package having a first mode of operation capable of storing said fluid material without leakage when said package is subjected to unintentional external forces and a second mode of operation capable of dispensing said fluid material when said package is subjected to external forces intentionally applied by the user, said second mode of operation being capable of dispensing said fluid material through a discharge orifice in response to manually applied forces and of automatically ceasing the dispensing operation when said manually applied forces are removed, said package also being resistance to leakage in said second mode of operation when stored with its discharge orifice downwardly oriented intermediate dispensing cycles, said package comprising:

(a) a resiliently deformable container for housing said fluid material, said container exhibiting a degree of flexibility sufficient to permit deformation thereof in response to manual forces applied thereto and a degree of resilience sufficient to return automatically to its undeformed condition when said manually applied forces are reomved therefrom, said container including said discharge orifice;

(b) a self-sealing dispensing valve which in said second mode of operation opens at a predetermined threshold pressure which is greater than the maximum hydraulic head pressure of the fluid material in said container when said discharge orifice is downwardly oriented, said dispensing valve having a centrally located portion comprised of resilient material, said centrally located portion exhibiting a predetermined concave shape while in a substantially unstressed condition, said centrally located concave shaped portion of said valve being sealingly secured about its periphery to one end of a resilient annular side wall portion of said valve, said resilient annular side wall portion of said valve defining an internal passageway which places the interior surface of said concave shaped portion of said valve in fluid communication with the interior of said resiliently deformable container, the other end of said resilient annular side wall portion of said valve being sealingly secured about its periphery across said discharge orifice of said container, said valve being oriented relative to said discharge orifice so that said centrally located resilient portion of said valve is inwardly concave when said container is in an undeformed condition, said concave shaped resilient portion of said valve further including at least one substantially linear slit extending through its thickness from its innermost surface to its outermost surface, said valve exhibiting an ability to undergo inversion in said second mode of operation from a closed, inwardly concave, sealed and leak resistant position to an open, outwardly convex, unsealed position when said manually applied forces increase the pressure inside said container beyond the threshold opening pressure of said valve, whereby fluid material is discharged from said container in said second mode of operation through said slit in said valve as long as said manually applied forces on said container maintain an internal pressure exceeding said threshold opening pressure of said valve, said valve further exhibiting an ability to cut-off said fluid material discharge by returning to a closed, inwardly concave sealed and leak resistant position in said second mode of operation whenever said manually applied forces are removed from said container;

(c) said package further including valve restraining means for preventing said valve from undergoing inversion and dispensing said fluid material whenever said package is subjected to unintentional external forces in said first mode of operation, said valve restraining means comprising a first peripheral restraint means for applying a radially oriented compressive force about the periphery of said concave shaped portion of said valve, said first peripheral restraint means tending to place said concave shaped portion of said valve in a state of radial compression in said first mode of operation, said valve restraining means further including a second exterior surface restraint means substantially coinciding with at least a portion of the exterior surface of said concave shaped portion of said valve to prevent inversion of said concave shaped portion of said valve when said package is in said first mode of operation, whereby fluid pressure generated within said container and applied at the point of joinder between said concave shaped portion of said valve and said annular side wall portion of said valve is resisted by said radially oriented compressive force applied by said first peripheral restraint means at the same time said concave shaped portion of said valve is prevented from undergoing inversion by said second exterior surface valve restraint means substantially coinciding with at least a portion of its outermost surface; and (d) said package further including annular side wall restraint means to prevent the portion of said annular side wall secured across said discharge orifice of said container from collapsing inwardly on said internal passageway in response to sudden increases in fluid pressure within said container in either said first mode of operation or said second mode of operation of said package, said annular side wall restraint means comprising an annular restraint member having an outside diameter substantially equal to the inside diameter of said internal passageway defined by said annular side wall portion of said valve, said annular side wall restraint means being secured in fixed relation to said discharge orifice in said container so that it extends through said internal passageway of said annular side wall portion of said valve at least in the area of said seal between said valve and said discharge orifice of said container, whereby fluid pressure generated within said container and applied against the interior surfaces of said concave shaped portion and said annular side wall portion of said valve is prevented from collapsing said annular side wall portion of said valve into said internal passageway in the area of said seal between said valve and said discharge orifice of said container by said annular side wall restraint means.

2. The package of claim 1, further including a baffle oriented substantially perpendicular to the axis of said internal passageway of said valve, said baffle being secured in fixed relation to said discharge orifice in said container in the path of fluid communication between the interior surface of said container, said baffle being so positioned that any fluid material approaching the interior surface of said concave shaped portion of said valve from the interior of said container must strike and be redirected about said baffle before reaching the interior surface of said concave shaped portion of said valve, whereby the severity of any shock loading applied to the interior surface of said concave shaped portion of said valve due to the application of sudden external forces on said container is greatly reduced.

3. The package of claim 2, wherein said baffle is secured to said annular side wall restraint means.

4. The package of claim 3, wherein the cross-sectional area for fluid material flow existing between said baffle and said annular side wall restraint means is at least substantially equal to the area of the interior surface of said concave shaped portion of said valve.

5. The package of claim 1 or claim 2, wherein said valve restraining means comprises a hinged, flip top closure which in its closed position provides said package with said first mode of operation and which in its open position provides said package with said second mode of operation.

6. The package of claim 1 or claim 2, wherein said valve restraining means comprises a removable closure which provides said pacakge with said first mode of operation when said closure is secured in place on said container and which provides said package with said second mode of operation when said closure is completely removed from said container.

7. The package of claim 5, wherein the clearance existing between said second exterior surface restraint means and the exterior surface of said concave shaped portion of said valve is sufficient to permit said concave shaped portion of said valve to undergo limited movement without inverting in response to fluid pressure generated within said container.

8. The package of claim 7, wherein said second exterior restraint means is contacted by the exterior surface of said concave shaped portion of said valve before said concave shaped portion of said valve can become substantially planar.

9. The package of claim 8, wherein the portion of said valve restraining means located interiorly of said first peripheral restraint means tending to place said ocncave shaped portion of said valve in a state of radial compression in said first mode of operation includes vent means to permit the air trapped in the area between said concave shaped portion ofsaid valve and the portion of said valve restraining mans located interiorly of said first peripheral restraing means to escape from said area when said concave shaped portion of said valve undergoes limited movement in response to fluid pressure generated within said container.

10. The package of claim 9, wherein said valve restraining means includes an outer chamber which is not exposed to the surrounding atmosphere whenever said package is in said firs tmode of operation and wherein said vent means places the area between said concave shaped portion of said valve and the portion of said valve restraining means located interiorly of said first peripheral restraint means in fluid communication with said outer chamber whenever said package is in said first mode of operation.

11. The package of claim 10, wherein said vent means comprises at least one groove in said first peripheral restraint means and at least one groove in said second exterior surface restraint means.

12. The package of claim 10, wherein said valve restraining means further includes vent means for placing said outer chamber in fluid communication with the surrounding atmosphere when said package is in said first mode of operation.

13. The package of claim 9, wherein said vent means places the area between said concave shaped portion of said valve and the portion of said valve restraining means located interiorly of said first peripheral restraint means in fluid communication with the surrounding atmosphere.

14. The package of claim 1 or claim 2, wherein said valve, said valve restraining means and said annular side wall restraint means are all secured to a valve securement member which is sealingly secured across the discharge orifice of said container.

15. The package of claim 14, wherein said baffle is also secured to said valve securement member.

16. The package of claim 14, wherein said valve securement member is releasably secured to said container.

17. The package of claim 16, wherein said valve securement member is releasably secured to said container by means of screw threads.

18. A flexible storage and dispensing package for fluid material, said package having a first mode of operation capable of storing said fluid material without leakage when said package is subjected to unintentional external forces and a second mode of operation of dispensing said fluid material when said package is subjected to external forces intentionally applied by the user, said second mode of operation being capable of dispensing said fluid material through a discharge orifice in response to manually applied forces and of automatically ceasing the dispensing operation when said manually applied forces are removed, said package also being resistant to leakage in said second mode of operation when stored with its discharge orifice downwardly oriented intermediate dispensing cycles, said package comprising:

(a) a resiliently deformable container for housing said fluid material, said container exhibiting a degree of flexibility sufficient to permit deformation thereof in response to manual resilience sufficient to return automatically to its underformed condition when said manually applied forces are removed therefrom, said container including said discharge orifice;

(b) a self-sealing dispensing valve which in said second mode of operation opens at a predetermined threshold pressure which is greater than the maximum hydraulic head pressure of the fluid material in said container when said discharge orifice is downwardly oriented, said dispensing valve having a centrally located portion comprised of resilient material, said centrally located portion exhibiting a predetermined concave shape while in a substantially unstressed condition, said centrally located concave shaped portion of said valve being sealingly secured about its periphery to one end of a resilient annular side wall portion of said valve, said resilient annular side wall portion of said valve defining an internal passageway which places the interior surface of said concave shaped portion of said valve in fluid communication with the interior of said resiliently deformable container, the other end of said resilient annular side wall portion of said valve being sealingly secured about its periphery across said discharge orifice of said container, said valve being oriented relative to said discharge orifice so that said centrally located resilient portion of said valve is inwardly concave when said container is in an undeformed condition, said concave shaped resilient portion of said valve further including at least one substantially linear slit extending through its thickness from its innermost surface to its outermost surface, said valve exhibiting an ability to undergo inversion in said second mode of operation from a closed, inwardly concave, sealed and leak resistant position to an open, outwardly convex, unsealed position when said manually applied forces increase the pressure inside said container beyond the threshold opening pressure of said valve, whereby fluid material is discharged from said container in said second mode of operation through said slit in said valve as long as said manually applied forces on said container maintain an internal pressure exceeding said threshold opening pressure of said valve, said valve further exhibiting an ability to cut-off said fluid material discharge by returning to a closed, inwardly concave, sealed and leak resistant position in said second mode of operation whenever said manually applied forces are removed from said container;

(c) said package further including valve restraining means for preventing said valve from undergoing inversion and dispensing said fluid material whenever said package is subjected to unintentional external forces in said first mode of operation, said valve restraining means comprising a first peripheral restraint means for applying a radially oriented compressive force about the periphery of said concave shaped portion of said valve, said first peripheral restraint means tending to place said concave shaped portion of said valve in a state of radial compression in said first mode of operation, said valve restraining means further including a second exterior surface restraint means substantially coinciding with at least a portion of the exterior surface of said concave shaped portion of said valve to prevent inversion of said concave shaped portion of said valve when said package is in said first mode of operation, whereby fluid pressure generated within said container and applied at the point of joinder between said concave shaped portion of said valve and said annular side wall portion of said valve is resisted by said radially oriented compressive force applied by said first peripheral restraint means at the same time said concave shaped portion of said valve is prevented form undergoing inversion by said second exterior surface valve restraint means substantially coinciding with at least a portion of its outermost surface;

(d) said package further including annular side wall restraint means to prevent the portion of said annular side wall secured across said discharge orifice of said container from collapsing inwardly on said internal passageway in response to sudden increases in fluid pressure within said container in either said first mode of operation or said second mode of operation of said package, said annular side wall restraint means comprising an annular restraint member having an outside diameter substantially equal to the inside diameter of said internal passageway defined by said annular side wall portion of said valve, said annular side wall restraint means being secured in fixed relation to said discharge orifice in said container so that it extends through said internal passageway of said annular side wall portion of said valve at least in the area of said seal between said valve and said discharge orifice of said container, whereby fluid pressure generated within said container and applied against the interior surfaces of said concave shaped portion and said annular side wall portion of said valve is prevented from collapsing said annular side wall portion of said valve into said internal passageway in the area of said seal between said valve and said discharge orifice of said container by said annular side wall restraint means; and (e) said package further including a baffle oriented substantially perpendicular to the axis of said internal passageway of said valve, said baffle being secured to said annular side wall restraint means in fixed relation to said discharge orifice in said container in the path of fluid communication between the interior surface of said concave shaped portion of said valve and the interior of said container, said baffle being so positioned that any fluid material approaching the interior surface of said concave shaped portion of said valve from the interior of said container must strike and be redirected about said baffle before reaching the interior surface of said concave shaped portion of said valve, whereby the severity of any shock loading applied to the interior surface of said concave shaped portion of said valve due to the application of sudden external forces on said container is greatly reduced.

19. The package of claim 18, wherein said valve restraining means comprises a hinged, flip top closure which in its closed position provides said package with said first mode of operation and which in its open position provides said package with said second mode of operation, the clearance existing between said second exterior restraint means and the exterior surface of said concave shaped portion of said valve being sufficient to permit said concave shaped portion of said valve to undergo limited movement without inverting in response to fluid pressure generated within said container.

20. The package of claim 19, wherein the portion of said valve restraining means located interiorly of said first peripheral restraint means tending to place said concave shaped portion of said valve in a state of radial compression in said first mode of operation includes vent means to permit the air trapped in the area between said concave shaped portion of said valve and the portion of said valve restraining mans located interiorly of said first peripheral restraint means to escape from said area when said concave shaped portion of said valve undergoes limited movement in response to fluid pressure generated within said container.

* * * * *

UNITED STATES PATENT AND TRADEMARK OFFICE

CERTIFICATE OF CORRECTION

PATENT NO. : 4,749,108

DATED : June 7, 1988

INVENTOR(S) : ARTHUR H. DORNBUSCH, JAMES L. DROBISH, ROGER E. SCHANZLE, LEO E. TASKE AND ROBERT W. BLAUT

It is certified that error appears in the above-identified patent and that said Letters Patent is hereby corrected as shown below:

Column 3, line 18, "an" should read -- and --.

Column 7, line 51, "auto-matically" should read -- automatically --.

Column 8, line 22, "this" should read -- This --.

Column 9, line 24, "uppermoste" should read -- uppermost --.

Column 9, line 37, "inventionc an," should read -- invention can, --.

Column 9, line 46, "categor" should read -- category --.

Column 9, line 49, "theart" should read -- the art --.

Column 9, line 57, "is" second occurrence should read -- it --.

Column 10, line 27 "itnerior" should read -- interior --.

Column 10, line 55, "which s" should read -- which is --.

Column 11, line 63, "restarining" should read -- restraining --.

Column 12, line 34, "teh" should read -- the --.

Column 13, line 3, "in" should read -- In --.

Column 13, line 21, "vale" should read -- valve --.

Column 13, line 47, "positons" should read -- positions --.

UNITED STATES PATENT AND TRADEMARK OFFICE

CERTIFICATE OF CORRECTION

PATENT NO. : 4,749,108

DATED : June 7, 1988

INVENTOR(S) : ARTHUR H. DORNBUSCH, JAMES L. DROBISH, ROGER E. SCHANZLE, LEO E. TASKE AND ROBERT W. BLAUT

It is certified that error appears in the above-identified patent and that said Letters Patent is hereby corrected as shown below:

Column 14, line 10, "dislodges" should read -- dislodged --.

Column 14, line 34, "flagne" should read -- flange --.

Column 14, line 34, "membe" should read -- member --.

Column 14, line 61, "estalish" should read -- establish --.

Column 14, line 62, "teh" should read -- the --.

Column 15, line 37, "ecured" should read -- secured --.

Column 16, line 25, "relattion" should read -- relation --.

Column 16, line 27, "inpackage" should read -- in package --.

Column 17, line 15, "int hose" should read -- in those --.

Column 17, line 61, "resistance" should read -- resistant --.

Column 18, line 3, "reomved" should read -- removed --.

Column 20, line 20, "ocncave" should read -- concave --.

Column 20, line 24, "ofsaid" should read -- of said --.

Column 20, line 25, "mans" should read -- means --.

Column 20, line 26, "restraing" should read -- restraint --.

UNITED STATES PATENT AND TRADEMARK OFFICE

CERTIFICATE OF CORRECTION

PATENT NO. : 4,749,108

DATED : June 7, 1988

INVENTOR(S) : ARTHUR H. DORNBUSCH, JAMES L. DROBISH, ROGER E. SCHANZLE, LEO E. TASKE AND ROBERT W. BLAUT

It is certified that error appears in the above-identified patent and that said Letters Patent is hereby corrected as shown below:

Column 20, line 33, "firs tmode" should read -- first mode --.

Column 22, line 28, "form" should read -- from --.

Signed and Sealed this

Twenty-ninth Day of November, 1988

*Attest:*

DONALD J. QUIGG

*Attesting Officer*

*Commissioner of Patents and Trademarks*